US008006491B2

(12) United States Patent
Narazaki et al.

(10) Patent No.: US 8,006,491 B2
(45) Date of Patent: Aug. 30, 2011

(54) PUMP CONTROL APPARATUS FOR CONSTRUCTION MACHINE

(75) Inventors: Akihiro Narazaki, Kasumigaura (JP); Kouji Ishikawa, Kasumigaura (JP); Nobuei Ariga, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 527 days.

(21) Appl. No.: 12/282,591

(22) PCT Filed: Jan. 22, 2008

(86) PCT No.: PCT/JP2008/050818

§ 371 (c)(1),
(2), (4) Date: Sep. 11, 2008

(87) PCT Pub. No.: WO2008/090890

PCT Pub. Date: Jul. 31, 2008

(65) Prior Publication Data

US 2009/0044528 A1 Feb. 19, 2009

(30) Foreign Application Priority Data

Jan. 22, 2007 (JP) ..... 2007-011830

(51) Int. Cl.
*F15B 11/02* (2006.01)
*E02F 99/22* (2006.01)

(52) U.S. Cl. ..... 60/452; 60/486

(58) Field of Classification Search ..... 60/452, 60/486
See application file for complete search history.

(56) References Cited

U.S. PATENT DOCUMENTS 4,023,364 A * 5/1977 Bianchetta ..... 60/486
4,354,420 A * 10/1982 Bianchetta ..... 60/486
7,076,947 B2 * 7/2006 Ariga et al. ..... 60/452

FOREIGN PATENT DOCUMENTS

| | | |
|---|---|---|
| JP | 59-085046 | 5/1984 |
| JP | 59-181283 | 12/1984 |
| JP | 10-159807 | 6/1998 |
| JP | 2002-242904 | 8/2002 |
| JP | 2003-113809 | 4/2003 |
| JP | 2003-239909 | 8/2003 |
| JP | 2004-108155 | 4/2004 |

* cited by examiner

*Primary Examiner* — Thomas E Lazo
(74) *Attorney, Agent, or Firm* — Mattingly & Malur, PC

(57) ABSTRACT

On the basis of reference torque and torque correction amount output units (T1 and T2), a torque control command pressure is calculated so that the input torques of first and second pumps are increased. The calculated torque command instruction pressure is then supplied as external command pressure to the varying mechanism of a regulator used for the first and second pumps so as to prevent the input torques of the first and second pumps from being decreased more than necessary. As a result, even when three variable displacement hydraulic pumps are used with the discharge pressure of one of the hydraulic pumps reduced by a pressure reducing valve and further the input torques of the other two hydraulic pumps are decreased by that pressure, the engine output can be efficiently utilized, and the work rate does not decrease.

2 Claims, 9 Drawing Sheets

PUMP CONTROL APPARATUS FOR CONSTRUCTION MACHINE

TECHNICAL FIELD

The present invention relates to a hydraulic circuitry that includes at least three engine-driven hydraulic pumps provided in a construction machine such as a hydraulic excavator, and more particularly to a pump control apparatus for a construction machine. The pump control apparatus is used to control the displacement volume of each hydraulic pump such that the consumption torque involved in driving each hydraulic pump does not exceed the output power of the engine and such that the engine output is efficiently utilized.

BACKGROUND ART

As its prior art, Patent Document 1 discloses a technology of this kind, for example. In this prior art, the pump control apparatus is formed of three variable displacement hydraulic pumps driven by one prime mover and of a plurality of actuators. The displacement volumes of the first and second hydraulic pumps are controlled on the basis of the self-discharge pressures P1 and P2 of these hydraulic pumps and the pressure P3' into which the discharge pressure P3 of the third hydraulic pump is reduced by a pressure reducing valve. When the discharge pressure P3' of the third hydraulic pump is high, the input torques of the first and second hydraulic pumps are controlled to be suppressed. In addition, the displacement volume of the third hydraulic pump is designed to be controlled only by the self-discharge pressure P3. The above mechanism can ensure a stable flow rate of the pressurized oil discharged from the third hydraulic pump without being influenced by fluctuations in the discharge flow rates of the first and second hydraulic pumps, or fluctuations in consumption torque. Further, the sum of the input torques of the first, second, and third hydraulic pumps is controlled not to exceed the available maximum power of the engine, whereby an overload on the engine can be prevented.

Patent document 1: JP, A 2002-242904

DISCLOSURE OF INVENTION

Problems to be Solved by the Invention

However, in the prior art disclosed in the above patent document 1, when the input torques of the first and second hydraulic pumps are controlled, the torques of the first and second hydraulic pumps 1 and 2 are decreased by the secondary pressure of the third hydraulic pump that is obtained through a pressure reducing valve. The pressure reducing valve is set at less than the maximum pressure P30 shown in FIG. 6. Accordingly, the torques are decreased on the basis of the torque decrease characteristics line Pk-Pl-Pm shown in FIG. 6. However, under the influence of the spring characteristics of a regulator or the like, the actual input torque of the third hydraulic pump takes values as indicated by an input torque line f. Accordingly, as shown in Area A in FIG. 6, the torques of the first and second hydraulic pumps are decreased more than the actual input torque of the third hydraulic pump by the secondary pressure into which the discharge pressure of the third hydraulic pump is reduced. Therefore, in an area in which the discharge pressure of the third hydraulic pump is higher than the maximum pressure P30, the prime mover output cannot be used efficiently, resulting in the problem of a decreased work rate.

An object of the present invention is to provide a pump control apparatus for a construction machine in which the prime mover output can efficiently be used without compromising the work rate in controlling the input torques of the first and second hydraulic pumps with the use of the discharge pressure of the third pump even when the input torques of the first and second hydraulic pumps are reduced with the secondary pressure of the third hydraulic pump into which its primary pressure is reduced by the pressure reducing valve.

Means for Solving the Problems

In order to achieve the above object, according to claim 1 of the present invention, there is provided a pump control apparatus for a construction machine, said pump control apparatus comprising:

a prime mover;

first, second, and third variable displacement pumps and a fixed displacement pilot pump, all driven by the prime mover;

specifying means for specifying a target revolution speed of the prime mover;

a control unit for controlling the revolution speed of the prime mover;

a regulator used for the first and second pumps, the regulator controlling the input torques of the first and second pumps on the basis of the discharge pressures of the first, second, and third pumps;

a regulator used for the third pumps, the regulator controlling the input torque of the third pump on the basis of the discharge pressure of the third pump; and limiting means for limiting the discharge pressure of the third pump, the discharge pressure being supplied to the regulator used for the first and second pumps, wherein:

said regulator used for the first and second pumps includes varying mechanisms for varying the input torques of the first and second pumps by external command pressure;

said pump control apparatus further includes:

a controller for calculating torque control command pressure as the external command pressure, the torque control command pressure being supplied to the regulator used for the first and second pumps;

torque control means for controlling the torque control command pressure; and pressure detection means for detecting the discharge pressure of the third pump; and said controller includes:

a torque correction amount output unit for outputting torque correction amounts of the first and second pumps on the basis of the discharge pressure of the third pump detected by the pressure detection means;

a reference torque output unit for outputting reference torque values of the first and second pumps on the basis of the target revolution speed of the prime mover specified by the specifying means; and an operation unit for calculating the torque control command pressure on the basis of an output value of the torque correction amount output unit and that of the reference torque output unit so as to increase the input torques of the first and second pumps such that input torques of the first and second pumps are controlled by the discharge pressure of the third pump.

In addition, according to claim 2 of the present invention, there is provided a pump control apparatus for a construction machine according to claim 1, said pump control apparatus further comprising revolution speed detection means for detecting the actual revolution speed of the prime mover, wherein:

said controller further includes a speed sensing torque correction output unit for outputting a correction value that is used to further correct the input torques of the first and second pumps by the deviation of the actual revolution speed from the target revolution speed specified by the specifying means; and said operation unit calculates the torque control command pressure on the basis of the correction values that are output from the torque correction output unit, the reference torque output unit, and the speed sensing torque correction amount output unit.

EFFECTS OF INVENTION

In accordance with claim 1 of the present invention as configured above, also in the case of decreasing the torques of the first and second hydraulic pumps 1 and 2 with the discharge pressure of the third hydraulic pump (secondary pressure) which is limited by the limiting means, the torques of the first and second hydraulic pumps are increased based on an actual discharge pressure of the third pump detected by the pressure detection means when the discharge pressure of the third hydraulic pump is limited by the limiting means and the limited discharge pressure may result in an excessive torque decrease of the first and second hydraulic pumps. Accordingly, the total input torque of all the hydraulic pumps can efficiently be used within a predetermined range in available engine output. Therefore, even if loads on the actuator driven by the pressurized oil from the third hydraulic pump increase, predetermined flow rates can be at least ensured as the discharge flow rates from the first and second hydraulic pumps without the displacement volumes of the first and second hydraulic pumps extremely reduced, thus preventing an excessive speed decrease in each of the actuators and ensuring preferable operability and work performance.

In accordance with claim 2 of the present invention, the speed sensing torque correction amount is determined from the deviation of the engine revolution speed detected by the revolution speed detection means from the target revolution speed set by specifying means. The sum of the three kinds of the torque correction amounts becomes the final total input torque of the hydraulic pumps. The three kinds of the torque correction amounts are the above-mentioned speed-sensing torque correction amount; the reference torque determined beforehand from the target revolution speed; and the torque correction amount of the first and second hydraulic pumps determined from the discharge pressure of the third hydraulic pump. The use of the above-mentioned sum enables the prevention of lug down of the engine even if a load suddenly acts on the actuator.

DESCRIPTION OF REFERENCE NUMBERS

1 First hydraulic pump
2 Second hydraulic pump
3 Third hydraulic pump
4 Pilot pump
5 Engine
6 Regulator (used for the first and second hydraulic pumps, equipped with a varying mechanism)
7 Regulator
14 Pressure reducing valve (limiting means)
29 Controller
30 Pressure sensor (pressure detection means)
35 Solenoid proportional valve (control means)
T1 Table (reference torque output unit)
T2 Table (torque correction amount output unit)
T5 Table (speed sensing torque correction amount output unit)

BEST MODES FOR CARRYING OUT THE INVENTION

First Embodiment

Figure 1:
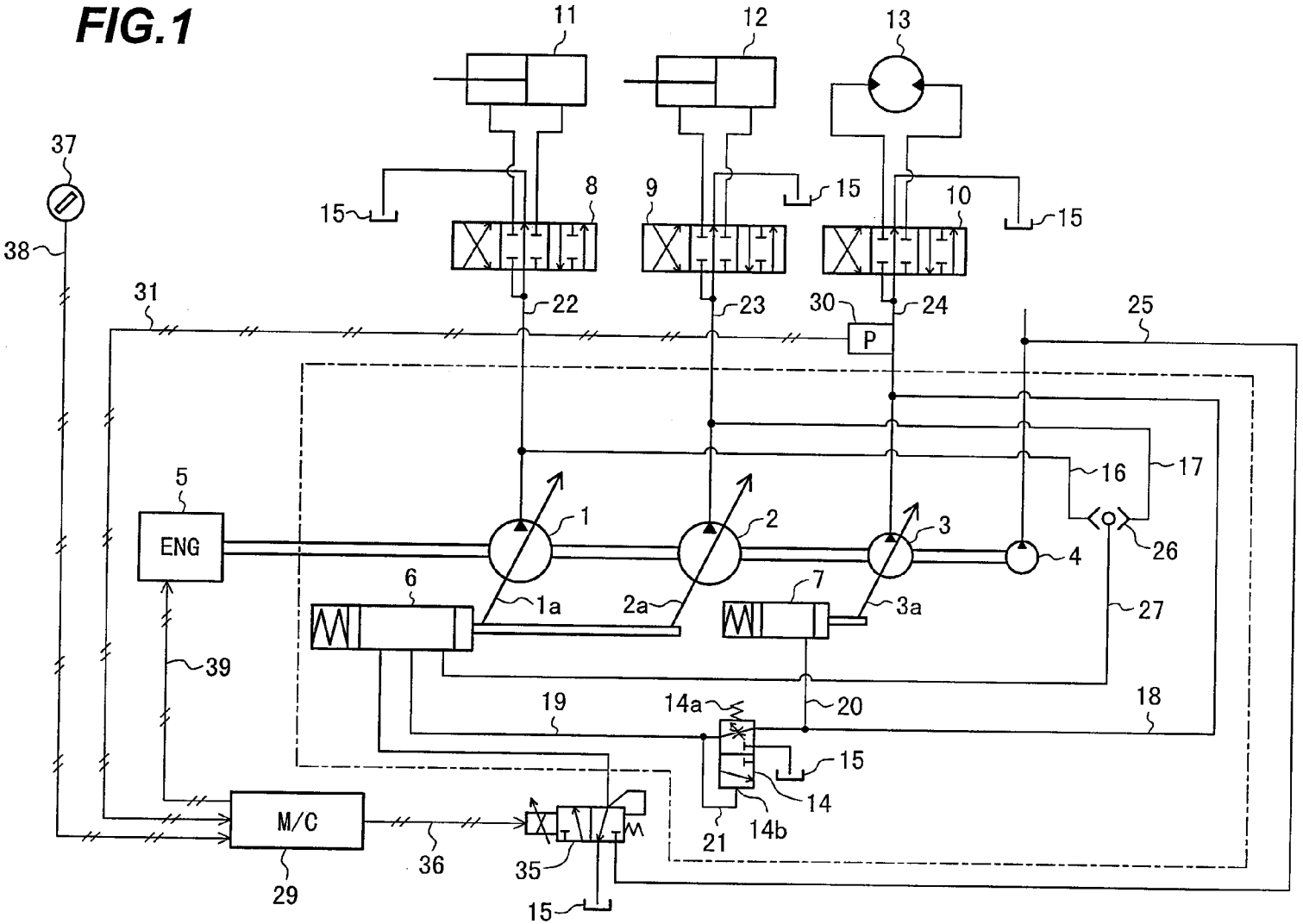
FIG. 1 is a hydraulic circuitry diagram according to a first embodiment of the present invention.
Figure 2:
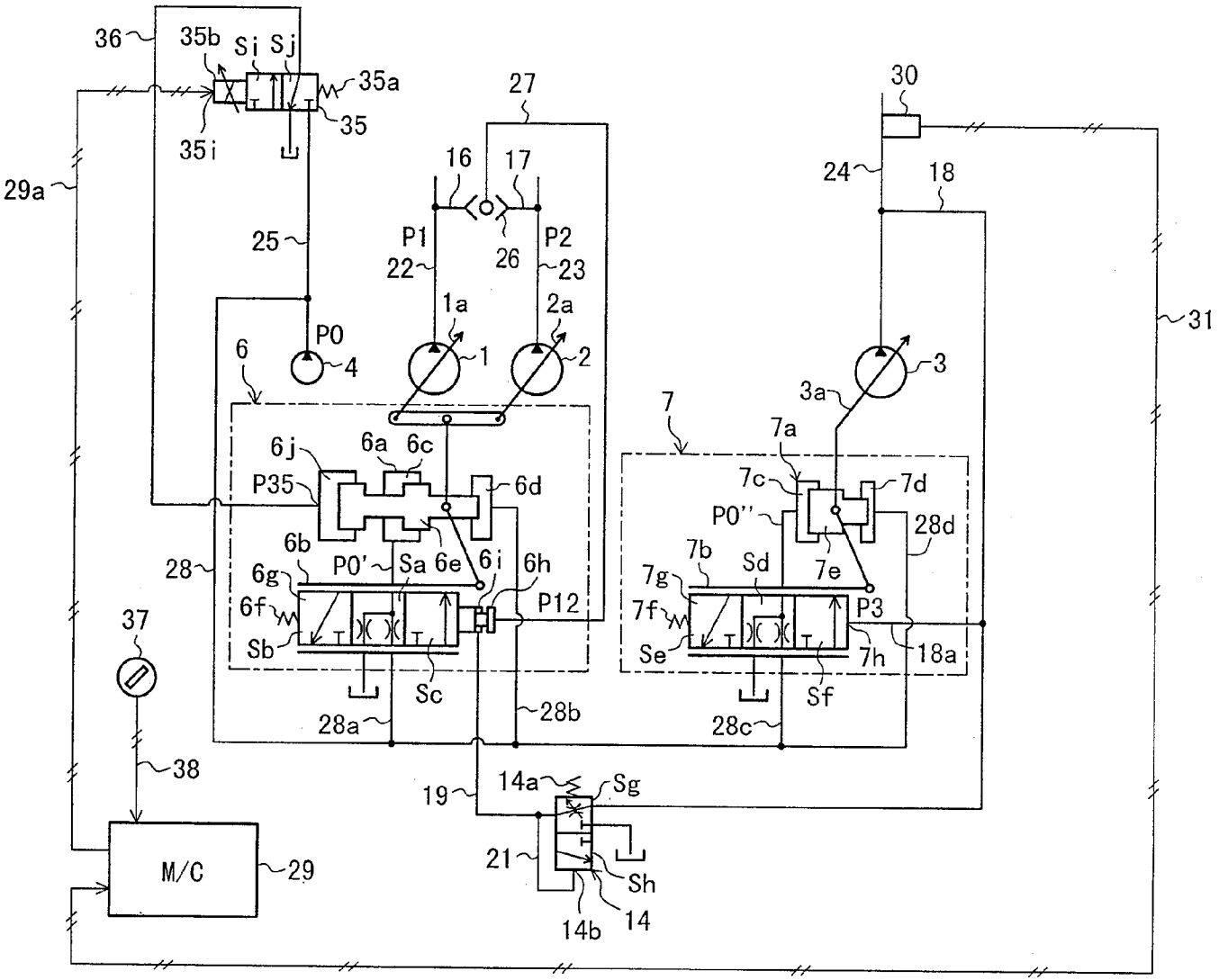
FIG. 2 is a hydraulic circuitry diagram illustrating its essential parts according to the first embodiment.
Figure 3:
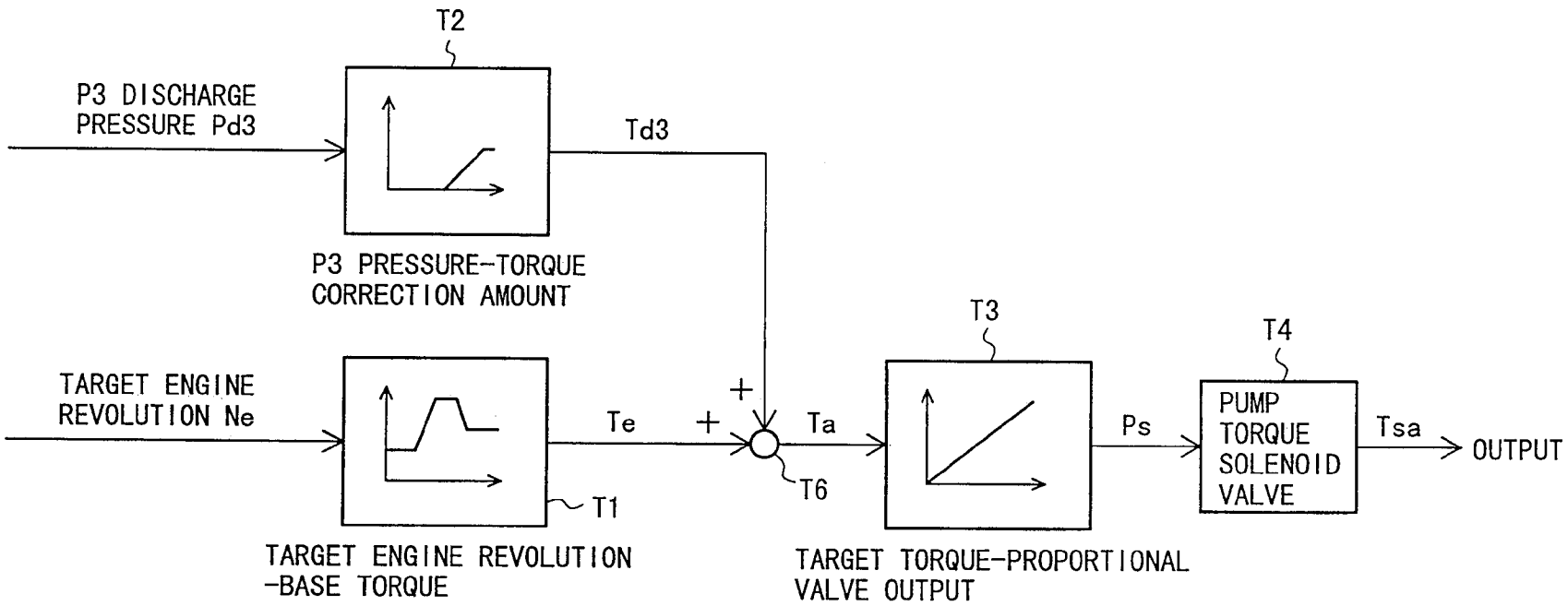
FIG. 3 is a control flow diagram according to the first embodiment.
Figure 4:
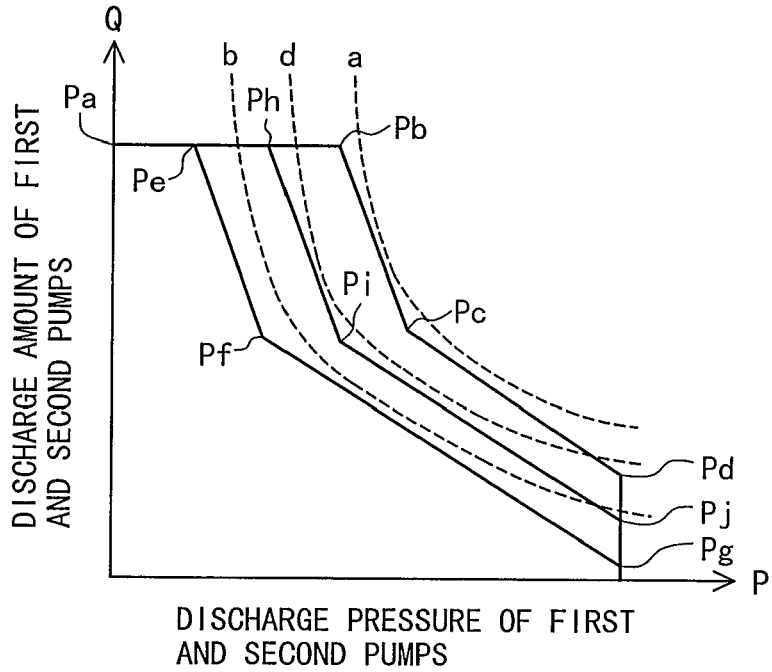
FIG. 4 is a graph illustrating the flow characteristics of first and second hydraulic pumps according to the first embodiment.
Figure 5:
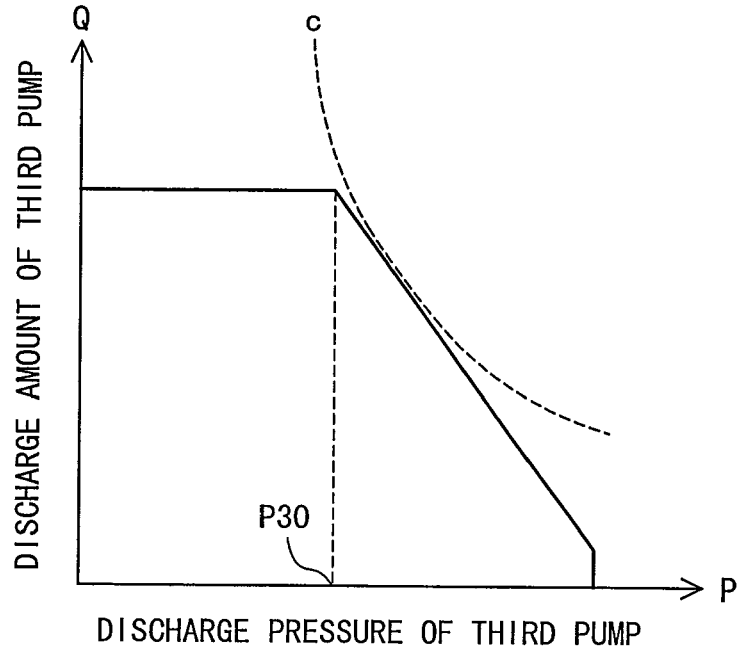
FIG. 5 is a graph illustrating the flow characteristics of a third hydraulic pump according to the first embodiment.
Figure 6:
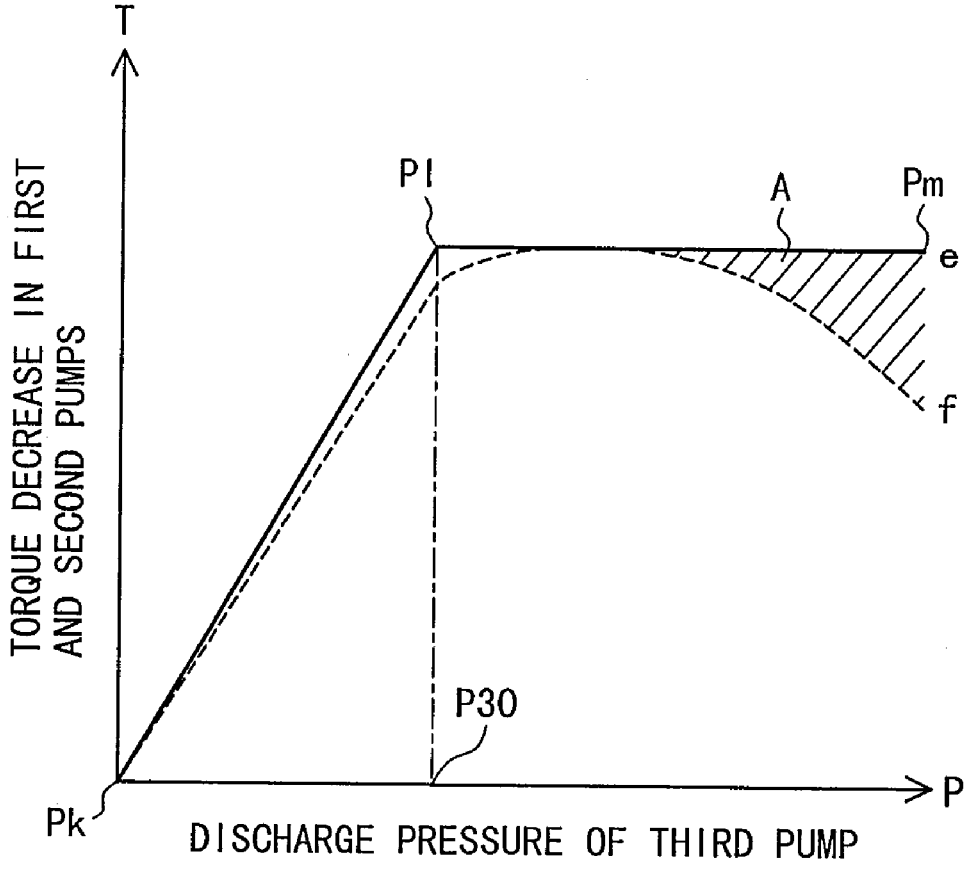
FIG. 6 is a graph illustrating the torque control characteristics of the third hydraulic pump and the actual input torque according to the first embodiment.
Figure 7:
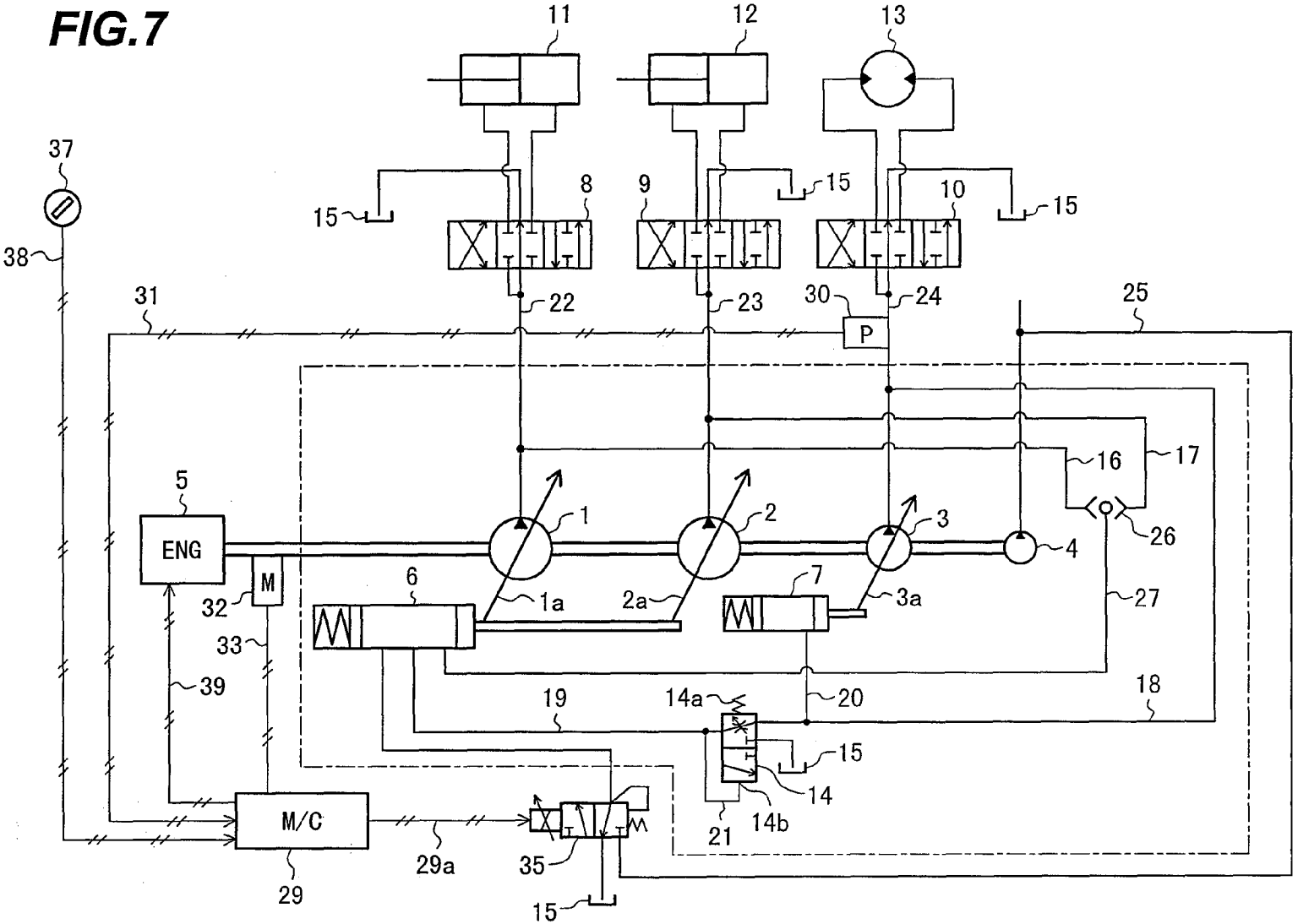
FIG. 7 is a hydraulic circuitry diagram according to a second embodiment of the present invention.
Figure 8:
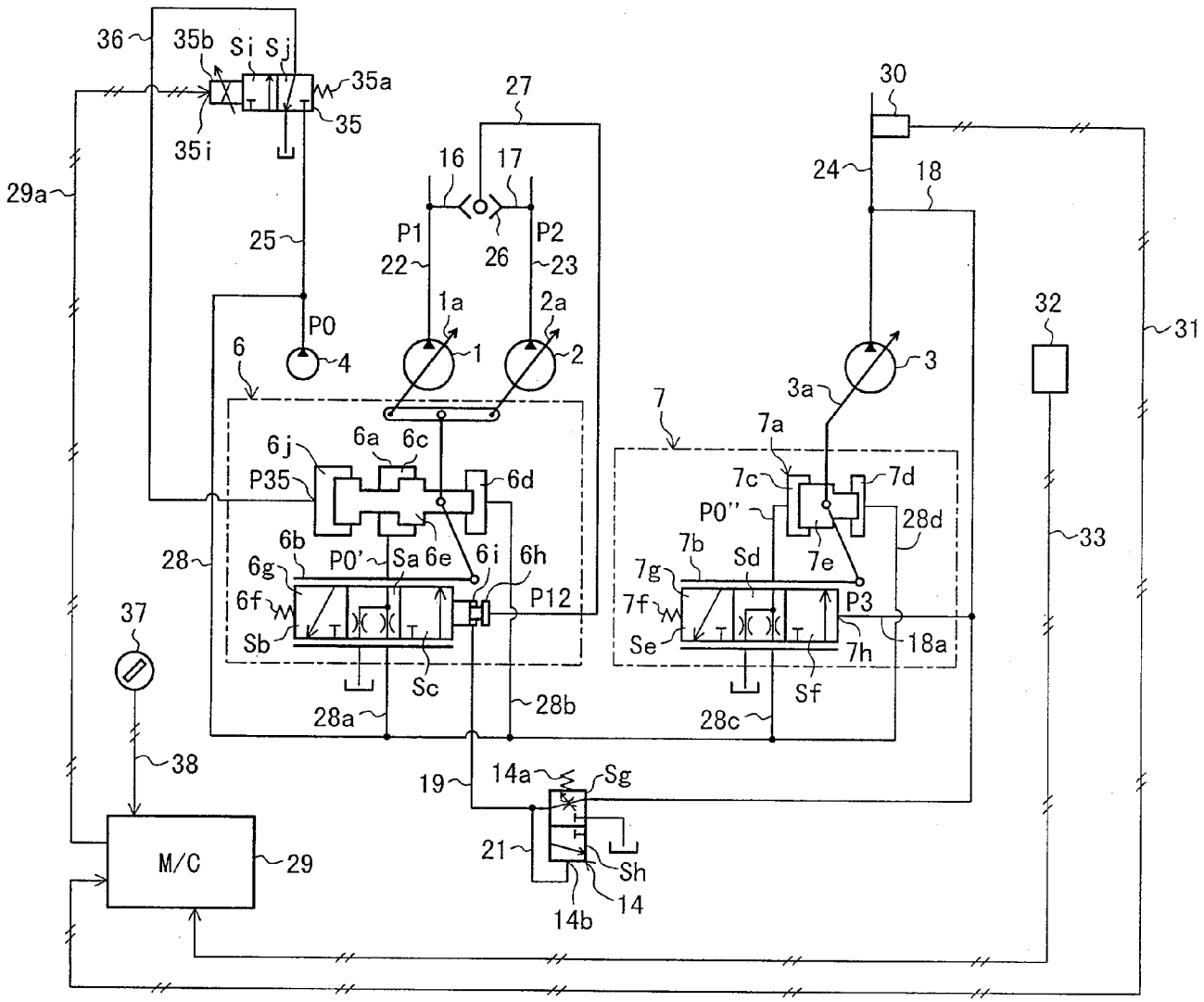
FIG. 8 is a hydraulic circuitry diagram illustrating its essential parts according to the second embodiment.
Figure 9:
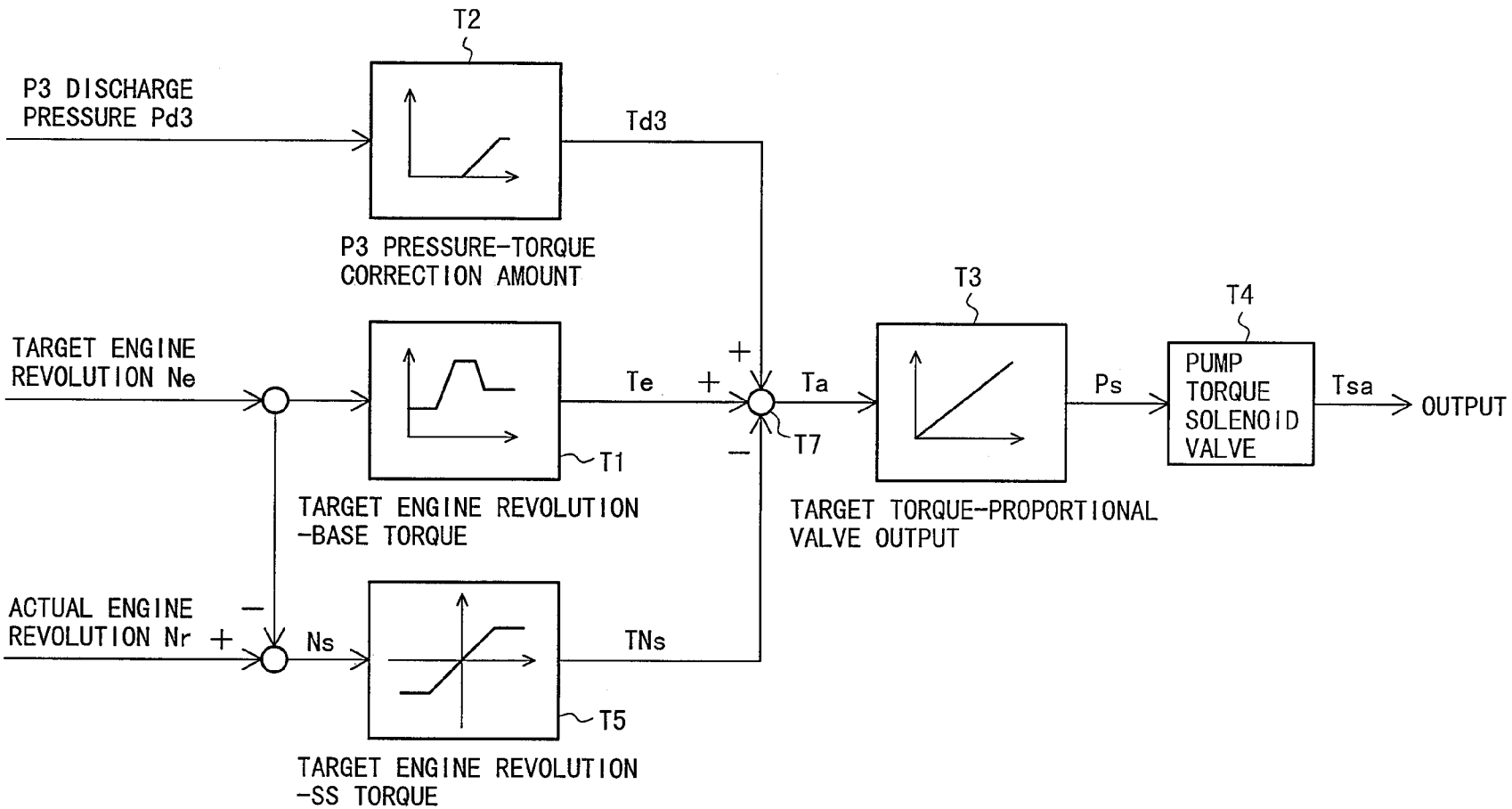
FIG. 9 is a control flow diagram according to the second embodiment.
Figure 10:
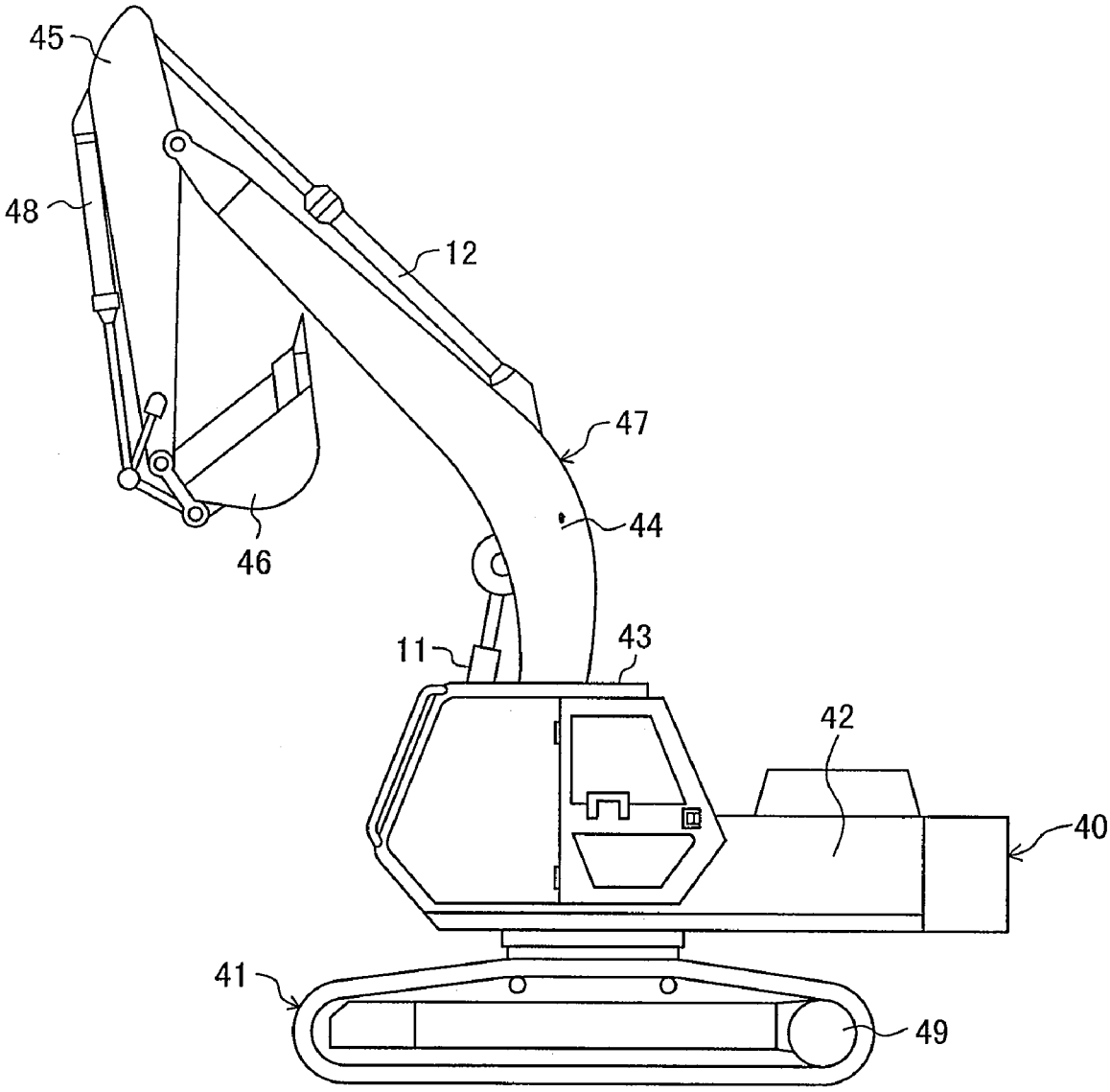
FIG. 10 is a diagram illustrating the appearance of a hydraulic excavator, a construction machine to which the present invention is applied.

A first embodiment of a hydraulic circuit for a construction machine according to the present invention will be described with reference to FIGS. 1 through 6 and FIG. 10. In this embodiment, the present invention is applied to a hydraulic excavator that is used as a construction machine. FIG. 1 is a diagram illustrating a hydraulic circuitry as a whole. FIG. 2 is a diagram illustrating important parts of the hydraulic circuitry. FIG. 3 is a flowchart illustrating the process flow performed by a controller. FIG. 4 is a graph illustrating discharge flow characteristics of first and second hydraulic pumps. FIG. 5 is a graph illustrating discharge flow characteristics of a third hydraulic pump. FIG. 6 is a graph illustrating torque decrease characteristics of the first and second pumps, which are changed by the discharge pressure of the third pump. FIG. 10 is an appearance diagram illustrating the hydraulic excavator.

First of all, the configuration of the hydraulic excavator according to the present invention will be described with reference to FIG. 10. The hydraulic excavator essentially includes: a track body 41 that travels, driven by a travel device 49 via a crawler belt; a swing body 40 that is placed on the track body 41 in such a manner that the swing body can be swung by the swing motor 13 (refer to FIG. 2); and a working device 47 that is placed at the front section of the swing body 40 such that the working device 47 can move up and down. The swing body 40 includes: a cabin 43; and a machine room 42 for accommodating driving sources including an engine 5 to be mentioned later and hydraulic pumps 1 and 2, and 3 (refer to FIG. 2 for each pump). The working device 47 includes: a boom 44 that is mounted on the front part of the swing body 40 such that the boom 44 can move up and down; an arm 45 that is provided at the tip of the boom 44; and a bucket 46 that is provided at the tip of the arm 45. The boom 44, the arm 45, and the bucket 46 are driven by a boom cylinder 11, an arm cylinder 12, and a bucket cylinder 48, respectively.

FIG. 1 is the overall view illustrating hydraulic circuits that are used for the boom cylinder 11, the arm cylinder 12, and the swing motor 13, respectively. Hydraulic circuits used for the bucket cylinder 48, a traveling motor, and an operation pilot system are omitted. As shown in FIG. 1, the hydraulic circuitry according to the first embodiment includes: the first, second, and third variable displacement hydraulic pumps 1 and 2, and 3 that are driven by the engine 5; and a fixed displacement pilot pump 4.

The flow of the pressurized oil discharged from the first, second, and third hydraulic pumps 1 and 2, and 3 to main lines 22, 23, and 24, respectively is controlled by directional control valves 8, 9, and 10, respectively. The discharged oil is then introduced into the boom cylinder 11, the arm cylinder 12, and the swing motor 13, respectively.

The first, second, and third hydraulic pumps 1 and 2, and 3 are swash plate pumps whose discharge flow rates (volume) per revolution can be adjusted by changing the tilting angles (the displacement volume) of respective displacement varying mechanisms 1*a*, 2*a*, and 3*a* (hereinafter referred to as "swash plates"). The tilting angle of each of the swash plates 1*a* and 2*a* is controlled by a regulator 6 that is volume control means used for the first and second pumps 1 and 2; the tilting angle of the swash plate 3*a* is controlled by a regulator 7 that is volume control means used for the third hydraulic pump.

Important parts of the hydraulic circuitry including the regulators 6 and 7 will be described with reference to FIG. 2. FIG. 2 omits the illustration of a mechanism for driving each actuator at the speed corresponding to an operation amount of a control lever (not illustrated in the figure). To be more specific, the mechanism in question is a flow control mechanism that increases or decreases the tilting angles of the hydraulic pumps in response to a flow rate requested by the hydraulic pumps so that each actuator is driven at the speed corresponding to an operational signal.

The regulator 6 has the function of controlling the input torque of the hydraulic pumps 1 and 2 by the self-pressure of the hydraulic pumps and the function of controlling the input torque of the hydraulic pumps by external command pressure. The regulator 7 has the function of controlling the input torque of the hydraulic pump 3 by the self-pressure of the hydraulic pump 3. The regulators 6 and 7 are formed of servo cylinders 6*a* and 7*a* and tilt control valves 6*b* and 7*b*, respectively. The servo cylinder 6*a* includes a differential piston 6*e* that is driven by the difference in pressure receiving area. The large-tilt-side pressure receiving chamber 6*c* of this differential piston 6*e* is connected to a pilot line 28*a* through the tilt control valve 6*b*. Pilot pressure P0, which is supplied through a pilot line 25, directly acts on the pressure receiving chamber 6*c*. In addition, the pressure receiving chamber 6*j* of the differential piston 6*e* is connected to the pilot line 25 through a pilot line 36 and a solenoid proportional valve 35 to be described later. Pilot pressure P35 reduced by the solenoid proportional valve 35 acts on the pressure receiving chamber 6*j*. When the large-tilt-side pressure receiving chamber 6*c* communicates with the pilot line 28*a*, the differential piston 6*e* is driven to the right in the figure by the difference in pressure receiving area. When the large-tilt-side pressure receiving chamber 6*c* communicates with a tank 15, the differential piston 6*e* is driven to the left in the figure by the difference in pressure receiving area. When the differential piston 6*e* moves to the right in the figure, the tilting angle of each of the swash plates 1*a* and 2*a*, that is, pump tilts, decreases. Accordingly, the discharge amount of each of the hydraulic pumps 1 and 2 decreases. On the other hand, when the differential piston 6*e* moves to the left in the figure, the tilting angle of each of the swash plates 1*a* and 2*a*, that is, pump tilts, increases. Accordingly, the discharge amount of each of the hydraulic pumps 1 and 2 increases. Moreover, the solenoid proportional valve 35 for reducing primary pilot pressure P0 is provided so that reduced secondary pilot pressure P35 is introduced into the externally controlled pressure receiving chamber 6*j* of the differential piston 6*e* through the line 36. The action of the secondary pilot pressure P35 on the externally controlled pressure receiving chamber 6*j* enables adjustment of the input torque of the first and second hydraulic pumps irrespective of the self-pressure of the hydraulic pumps 1 and 2 and the discharge pressure of the third pump. To be more specific, when the secondary pilot pressure P35 increases, the balance of the servo piston 6*e* is controlled by three kinds of pushing forces, that is to say, (6*j* pushing force+6*c* pushing force) and (6*d* pushing force), so that pump tilting is controlled. Therefore, when the secondary pilot pressure P35 is increased, the tilt control of the first and second hydraulic pumps 1 and 2 is performed with the discharge pressures of the first and second hydraulic pumps 1 and 2 in a lower state than when the secondary pilot pressure P35 is not increased. Accordingly, the input torque of the first and second pumps becomes low. In contrast to this, when the secondary pilot pressure P35 is not increased, the externally controlled pressure receiving chamber 6*j* communicates with the tank 15 through the pilot line 36, and accordingly, the 6*j* pushing force of the servo piston 6*e* is not present. As a result, the balance of the servo piston 6*e* is controlled by two kinds of the pushing forces, that is to say, (the 6*c* pushing force) and (the 6*d* pushing force), so that the pump tilting is controlled. Therefore, when the secondary pilot pressure P35 is not increased, the tilt control of the first and second hydraulic pumps 1 and 2 is performed with the discharge pressures of the first and second hydraulic pumps 1 and 2 in a higher state than when the secondary pilot pressure P35 is increased. Accordingly, the input torque of the first and second pumps becomes higher than when the secondary pilot pressure P35 is not increased.

The servo cylinder 7*a* includes a differential piston 7*e* that is driven by the difference in pressure receiving area. The large-tilt-side pressure receiving chamber 7*c* of this differential piston 7*e* is connected to a pilot line 28*c* through the tilt control valve 7*b*. Pilot pressure P0 supplied through the pilot line 28 directly acts on the pressure receiving chamber 7*c*. When the large-tilt-side pressure receiving chamber 7*c* communicates with the pilot line 28*c*, the differential piston 7*e* is driven to the right in the figure by the difference in pressure receiving area. When the large-tilt-side pressure receiving chamber 7*c* communicates with a tank 15, the differential piston 7*e* is driven to the left in the figure by the difference in pressure receiving area. When the differential piston 7*e* moves to the right in the figure, the tilting angle of the swash plate 3*a*, that is, the tilt of the pump 3, decreases. Accordingly, the discharge amount of the hydraulic pump 3 decreases. On the other hand, when the differential piston 7*e* moves to the left in the figure, the tilting angle of the swash plate 3*a*, or the tilt of the pump 3, increases. Accordingly, the discharge amount of the hydraulic pump 3 increases.

The tilt control valves 6*b* and 7*b* are valves used to limit the input torque and are formed of spools 6*g* and 7*g*, springs 6*f* and 7*f*, and operation drivers 6*h* and 6*i*; 7*h*, respectively. Pressurized oil discharged from the first pump (discharge pressure P1) and pressurized oil discharged from the second pump (discharge pressure P2) are introduced into a shuttle valve 26 through lines 16 and 17 that branch from the main lines 22 and 23, respectively. Pressurized oil on the high pressure side (pressure P12), which is selected by the shuttle valve 26, is introduced through a line 27 into the operation driver 6*h* of the tilt control valve 6*b* used for the first and second hydraulic pumps 1 and 2. In addition, pressurized oil discharged from the third hydraulic pump (discharge pressure P3) is depressurized (into pressure P3') by a pressure reducing valve 14, limiting means to be described later, that is provided on a line 18 branching from the main line 24. The discharged oil in question is then introduced into the other operation driver 6*i* through a line 19. On the other hand, the discharge pressure P3 from the third hydraulic pump is directly introduced into the operation driver 7*h* of the tilt control valve 7*b* used for the third pump through the line 18 and a line 18*a* branching from the line 18. Moreover, the position of each of the tilt control valves 6*b* and 7*b* is controlled in response to the pushing force by the springs 6*f* and 7*f* and the pushing force by oil pressure applied to the operation drivers 6*h*, 6*i*, and 7*h*.

The pressure reducing valve 14 includes: a spring 14*a*; and a pressure receiving unit 14*b* to which the discharge pressure is fed back. When the discharge pressure P3 of the third hydraulic pump 3 becomes equal to or higher than a specified pressure value that is set by the spring 14*a*, the pressure reducing valve 14 reduces its opening. As a result, the discharge pressure P3 of the third hydraulic pump 3 is reduced, and accordingly, the pressure P3' which is introduced into the operation driver 6*i* of the tilt control valve 6*b* is controlled not to exceed the specified pressure value. In this embodiment, the value of the spring 14*a* is set at the maximum pressure P30 below which the discharge flow control of the third hydraulic pump 3 shown in FIG. 5 is not carried out. Reference numeral 15 denotes a storage tank for storing pressurized oil.

When electric current 35*i* is applied to the solenoid 35*b* of the solenoid proportional valve 35, the spool of the solenoid proportional valve 35 moves in response to this current value, and the valve position thereof moves to the Si and Sj side. The movement of this spool causes the pilot line 25 and the line 36 to gradually communicate with each other, and the secondary pilot pressure P35 becomes larger with increase in current value 35*i*. As a result, the secondary pilot pressure P35 is supplied to the externally controlled pressure receiving chamber 6*j* of the tilt control differential piston 6*e*.

A pressure sensor 30 detects the discharge pressure (P3) of the third hydraulic pump 3 and transmits command voltage to a controller 29.

The controller 29 performs the steps of: determining the torque increase correction amount Td3 of the first and second hydraulic pumps 1 and 2 from the discharge pressure Pd3 of the third hydraulic pump 3 detected by the pressure sensor 30 and from preset Table T2 showing the relationship between the discharge pressure Pd3 of the third hydraulic pump 3 and the torque correction amount; determining reference torque Te from a target engine revolution speed Ne set by an engine revolution control dial 37 and from preset Table T1 showing the relationship between the target engine revolution speed Ne and the reference torque; adding the above-mentioned reference torque Te to the torque increase correction amount Td3 of the first and second hydraulic pumps 1 and 2 by use of a controller operation unit T6 to determine a target torque Ta; determining solenoid proportional valve output Ps from preset Table T3 showing the relationship between the target torque Ta and proportional valve output Ps; and determining a current value Tsa to be output to the solenoid valve 35 from Table T4 showing solenoid-valve output characteristics. The torque increase correction amount Td3, determined from Table T2, is a value that is determined beforehand by experiments as an increase torque amount used to compensate for the decreased torque in Area A shown in FIG. 6 in consideration of, for example, the spring characteristics of the regulator 7 of the third hydraulic pump 3.

In the thus-configured hydraulic circuitry of the construction machine according to the first embodiment, when the boom cylinder 11 is operated, the tilting angle of the regulator 6 is increased by a flow control mechanism (not illustrated in the figures) in response to a requested flow rate. This increases the discharge flow from the first hydraulic pump 1. The increase in discharge flow rate and the load pressure of the boom cylinder 11, in turn, increase the discharge pressure P1 from the first hydraulic pump 1. As a result, the pressure P12 of the operation driver 6*h* of the tilt control valve 6*b* increases, and accordingly, the pushing force of the spool 6*g* in the left direction in FIG. 2 increases. When the pushing force of the spool 6*g* in the left direction exceeds the pushing force generated by the spring 6*f* in the right direction, the spool 6*g* moves to the left, and the valve position thereof moves to the Sc side. As a result, the large-tilt-side pressure receiving chamber 6*c* of the servo cylinder 6*a* and the pilot line 28*a* communicate with each other. As described above, when the large-tilt-side pressure receiving chamber 6*c* of the servo cylinder 6*a* and the pilot line 28*a* communicate with each other, the differential piston 6*e* moves to the right side of FIG. 2 by the difference in pressure receiving area between the pressure receiving chambers 6*c* and 6*d* of the servo cylinder 6*a*, and accordingly, the tilting angle of each of the swash plates 1*a* and 2*a* decreases. Meanwhile, because the swing motor 13 is not operating, the discharge pressure P3 of the third hydraulic pump 3 is kept in a low pressure state, and the pressure P3' to be applied to the other operation driver 6*i* of the tilt control valve 6*b* is also kept in an extremely low pressure state. Because the discharge pressure P3 of the third hydraulic pump 3 is kept in the low pressure state, the proportional valve output at this point of time satisfies the reference torque Te determined from the target engine revolution speed Ne.

When the swing motor 13 is not operating as above, the tilting angles of the first and second hydraulic pumps 1 and 2 are controlled by the discharge pressure P1 of the first hydraulic pump 1 or the discharge pressure P2 of the second hydraulic pump 2. Accordingly, their discharge flow rates change along the flow characteristics line Pa-Pb-Pc-Pd shown in FIG. 4. To be more specific, if the discharge pressures P1 and P2 from the first and second hydraulic pumps 1 and 2, respectively, are relatively low, their tilting angles are large, and the discharge flow rates are also high. However, with increase in discharge pressures P1 and P2, the tilting angles and the discharge flow rates are decreased. As a result, the tilting angles are controlled such that the discharge flow rates do not exceed the maximum input torque a (the curve a indicated by a broken line) that is assigned beforehand to the first and second hydraulic pumps 1 and 2.

In such a situation, when the swing motor 13 is put into operation, the discharge flow from the third hydraulic pump 3 is increased by a flow control mechanism (not illustrated in the figures). As a result, the tilting angle of the swash plate 3*a* of the hydraulic pump 3 decreases along the flow characteristics line shown in FIG. 5 in response to the discharge pressure P3 by the substantially same operation as the above-mentioned operation of the boom cylinder 11. To be more specific, the tilting angle is controlled such that the discharge flow rate of the third hydraulic pump does not exceed the maximum input torque c (the curve c indicated by a broken line) that is predetermined for the third hydraulic pump 3.

In this case, because the influence of the discharge pressures P1 and P2 from the first and second hydraulic pumps 1 and 2, respectively, is not exerted on the control by the regulator 7 used for the third hydraulic pump 3, the supply flow rate from the third hydraulic pump 3 to the swing motor 13 never fluctuates even if, for example, the load pressure of the boom cylinder 11 fluctuates.

On the other hand, the discharge pressure P3 from the third hydraulic pump 3 is introduced through the pressure reducing valve 14 into the regulator 6 used for the first and second hydraulic pumps 1 and 2. To be more specific, the discharge pressure P12 from the first and second hydraulic pumps 1 and 2 works on the operation driver 6*h* of the tilt control valve 6*b*. In addition, the pressure P3', or the depressurized discharge pressure P3 from the third hydraulic pump 3, is applied to the other operation driver 6*i*. Therefore, the tilting angles of the first and second hydraulic pumps 1 and 2 are further decreased by the regulator 6 in comparison with the case where the swing motor 13 is not operating. Here, the discharge pressure P3 of the third hydraulic pump 3 detected by the pressure sensor 30 is transmitted to the controller 29. As described above, the controller 29 performs the steps of: determining the torque increase correction amount Td3 of the first and second hydraulic pumps 1 and 2 from the discharge pressure Pd3 of the third hydraulic pump 3 detected by the pressure sensor 30 and from preset Table T2 showing the relationship between the discharge pressure Pd3 of the third hydraulic pump 3 and the torque correction amount; determining reference torque Te from a target engine revolution speed Ne set by the engine revolution control dial 37 and from preset Table T1 showing the relationship between the target engine revolution speed Ne and the reference torque; adding the above-mentioned reference torque Te to the torque increase correction amount Td3 of the first and second hydraulic pumps 1 and 2 by use of a controller operation unit T6 to determine a target torque Ta; determining solenoid proportional valve output Ps from preset Table T3 showing the relationship between the target torque Ta and proportional valve output Ps; and determining a current value Tsa to be output to the solenoid valve 35 from Table T4 showing solenoid-valve output characteristics, from which solenoid proportional valve the external command pressure P35 is supplied. In response to the value of the pressure P3' applied from the pressure reducing valve 14 and that of the external command pressure P35 supplied from the solenoid proportional valve 35, the discharge flow rates of the first and second hydraulic pumps are controlled such that their values fall within a range that is defined by an area surrounded by the flow characteristics line Pa-Pb-Pc-Pd-Pg-Pf-Pe shown in FIG. 4. As described above, the spring 14*b* of the pressure reducing valve 14 is set such that the pressure P3' to be transferred to the tilt control valve 6*b* becomes less than P30; the flow rate indicated by the flow characteristics line Pa-Ph-Pi-Pj is ensured for the flow characteristics line Pe-Pf-Pg. The former characteristics line takes as its target torque d (the curve d indicated by a broken line in FIG. 4) that is obtained by adding the torque increase amount to torque b (the curve b indicated by a broken line in FIG. 4) obtained by subtracting the input torque of the third hydraulic pump 3, equivalent to the pressure P30, from the maximum input torque a of the first and second hydraulic pumps 1 and 2. Here, said torque d changes in response to the discharge pressure P3 of the third hydraulic pump as described above; thus, the torque d lies between the torque a (the curve a indicated by the broken line in FIG. 4) and the torque b (the curve b indicated by the broken line in FIG. 4). Therefore, even if a swing load becomes large, with the result that the discharge pressure P3 from the third hydraulic pump 3 increases, at least the flow rate indicated by the flow characteristics line Pa-Ph-Pi-Pj is ensured as the discharge flow rates from the first and second hydraulic pumps 1 and 2. This makes it possible to prevent the operation speed of the boom cylinder 11 and that of the arm cylinder 12 from extremely decreasing. At the same time, even if a load on the actuator which is driven by pressurized oil supplied from the third hydraulic pump increases, at least the predetermined flow rate can be ensured as the discharge flow rates from the first and second hydraulic pumps without extremely decreasing the displacement volume of the first and second hydraulic pumps. Therefore, extreme speed decrease in each of the actuators can be prevented, thereby ensuring preferable operability and work performance.

Thus, the hydraulic circuitry of the construction machine according to the first embodiment enables efficient use of its engine output by not decreasing the discharge flow rates from the first and second hydraulic pumps 1 and 2 more than necessary even if the swing load increases and by increasing an excessively decreased torque due to the discharge pressure P3' of the third hydraulic pump 3 on the side of the first and second hydraulic pumps 1 and 2. Therefore, extreme speed decrease in the boom cylinder 11 and the arm cylinder 12 can be prevented, thereby ensuring preferable operability.

Second Embodiment

In comparison with the configuration of the first embodiment, the configuration of a second embodiment additionally includes: an engine revolution speed sensor 32 for detecting an actual engine revolution speed; and wiring 33 for transmitting to the controller 29 the actual engine revolution speed detected by this engine revolution sensor 32.

The controller 29 performs the steps of: determining the torque increase correction amount Td3 of the first and second hydraulic pumps from the discharge pressure Pd3 of the third hydraulic pump 3 detected by the pressure sensor 30 and from preset Table T2 showing the relationship between the discharge pressure Pd3 of the third hydraulic pump 3 and the torque correction amount; determining reference torque Te from a target engine revolution speed Ne set by the engine revolution control dial 37 and from preset Table T1 showing the relationship between the target engine revolution speed Ne and the reference torque; determining a torque correction amount TNs from the deviation of an actual engine revolution speed Nr detected by the engine revolution sensor 32 from the target engine revolution speed Ne (Nr-Ne) and from preset Table T5 showing the relationship between the deviation of the actual engine revolution speed Nr detected by the engine revolution sensor 32 from the target engine revolution speed Ne and the torque correction amount; by use of a controller operation unit T7, determining the target torque Ta by performing addition or subtraction operations on the torque correction amount TNs determined from the difference between the actual engine revolution speed Nr and the target engine revolution speed Ne, the reference torque Te, and the torque increase correction amount Td3 of the first and second hydraulic pumps; determining the solenoid proportional valve output Ps from preset Table T3 showing the relationship between the target torque Ta and the proportional valve output; and determining a current value Tsa to be transmitted to the solenoid valve from Table T4 showing the solenoid-valve output characteristics.

In addition to the effects of the first embodiment, the second embodiment described above produces the following effect: the torque correction of the hydraulic pumps 1 and 2 based also on a load acting on the engine enables the prevention of engine revolution lug-down in a state in which a sudden load is placed on the actuators as a result of the sudden operation of a lever.

The invention claimed is:

1. A pump control apparatus for a construction machine, said pump control apparatus comprising:

a prime mover;

first, second, and third variable displacement pumps and a fixed displacement pilot pump, all driven by the prime mover;

specifying means for specifying a target revolution speed of the prime mover;

a control unit for controlling the revolution speed of the prime mover;

a regulator used for the first and second pumps, the regulator controlling the input torques of the first and second pumps on the basis of the discharge pressures of the first, second, and third pumps;

a regulator used for the third pumps, the regulator controlling the input torque of the third pump on the basis of the discharge pressure of the third pump; and limiting means for limiting the discharge pressure of the third pump, the discharge pressure being supplied to the regulator used for the first and second pumps, wherein:

said regulator used for the first and second pumps includes varying mechanisms for varying the input torques of the first and second pumps by external command pressure;

said pump control apparatus further includes:

a controller for calculating torque control command pressure as the external command pressure, the torque control command pressure being supplied to the regulator used for the first and second pumps;

torque control means for controlling the torque control command pressure; and pressure detection means for detecting the discharge pressure of the third pump; and said controller includes:

a torque correction amount output unit for outputting torque correction amounts of the first and second pumps on the basis of the discharge pressure of the third pump detected by the pressure detection means;

a reference torque output unit for outputting reference torque values of the first and second pumps on the basis of the target revolution speed of the prime mover specified by the specifying means; and an operation unit for calculating the torque control command pressure on the basis of an output value of the torque correction amount output unit and that of the reference torque output unit.

2. The pump control apparatus for a construction machine according to claim 1, said pump control apparatus further comprising revolution speed detection means for detecting the actual revolution speed of the prime mover, wherein:

said controller further includes a speed sensing torque correction output unit for outputting a correction value that is used to further correct the input torques of the first and second pumps by the deviation of the actual revolution speed from the target revolution speed specified by the specifying means; and said operation unit calculates the torque control command pressure on the basis of the correction values that are output from the torque correction output unit, the reference torque output unit, and the speed sensing torque correction amount output unit.

* * * * *